US008875868B2

(12) United States Patent
Auf der Maur

(10) Patent No.: US 8,875,868 B2
(45) Date of Patent: Nov. 4, 2014

(54) APPARATUS FOR ALIGNING A SHEET PRODUCT

(75) Inventor: Konrad Auf der Maur, Gossau (CH)

(73) Assignee: Ferag AG, Hinwil (CH)

( * ) Notice: Subject to any disclaimer, the term of this patent is extended or adjusted under 35 U.S.C. 154(b) by 329 days.

(21) Appl. No.: 13/193,359

(22) Filed: Jul. 28, 2011

(65) Prior Publication Data

US 2012/0031733 A1 Feb. 9, 2012

(30) Foreign Application Priority Data

Aug. 6, 2010 (CH) ..... 2010 01274/10

(51) Int. Cl.

| | |
|---|---|
| ***B65G 47/24*** | (2006.01) |
| ***B65H 9/10*** | (2006.01) |
| ***B65H 5/02*** | (2006.01) |
| ***B65H 5/16*** | (2006.01) |
| ***B65H 9/16*** | (2006.01) |

(52) U.S. Cl.

CPC ..... *B65H 9/103* (2013.01); *B65H 5/021* (2013.01); *B65H 5/16* (2013.01); *B65H 9/163* (2013.01); *B65H 2404/268* (2013.01)

USPC ..... 198/416; 198/415; 198/434

(58) Field of Classification Search

None

See application file for complete search history.

(56) References Cited

U.S. PATENT DOCUMENTS

| | | | | |
|---|---|---|---|---|
| 4,178,118 | A * | 12/1979 | Bailey | 414/788 |
| 4,426,073 | A | 1/1984 | Mizuma | |
| 5,191,962 | A | 3/1993 | Wegscheider et al. | |
| 5,697,609 | A | 12/1997 | Williams et al. | |
| 5,836,439 | A | 11/1998 | Coyette | |
| 5,873,451 | A | 2/1999 | Backman | |
| 5,884,747 | A | 3/1999 | Sandstedt et al. | |
| 6,561,503 | B1 * | 5/2003 | Ogata et al. | 270/58.12 |
| 6,868,653 | B2 * | 3/2005 | Ballestrazzi et al. | 53/447 |
| 2010/0078292 | A1 | 4/2010 | Honegger et al. | |

FOREIGN PATENT DOCUMENTS

| | | |
|---|---|---|
| CH | 699597 | 3/2010 |
| CH | 699 866 | 5/2010 |
| DE | 1987058 | 6/1968 |
| DE | 3232364 | 3/1984 |

(Continued)

OTHER PUBLICATIONS

European Patent Office, Extended European Search Report for Application No. 11004987.1 Aug. 9, 2012, 3 pages, The Netherlands.

(Continued)

*Primary Examiner* — Kavel Singh

(74) *Attorney, Agent, or Firm* — Alston & Bird LLP

(57) ABSTRACT

The invention relates to an apparatus for aligning a sheet product conveyed on a conveying surface of a conveyor system in a direction of conveyance at a conveying velocity, which product has on its side facing away from the conveying surface an at least partially exposed surface. The apparatus has an alignment unit, which is arranged above the conveying surface and which is intended to change the situation of the product with respect to the conveying surface by means of a force acting upon the exposed surface. The alignment unit has a self-contained, flexible force transmission member, which, on that side of the alignment unit which is facing toward the conveying surface, forms a sagging strand, which latter is intended to rest with a portion on the at least partially exposed surface of the product and thus subject said product to the force.

15 Claims, 7 Drawing Sheets

(56) References Cited

FOREIGN PATENT DOCUMENTS

| | | |
|---|---|---|
| DE | 199313250 U1 | 12/1993 |
| DE | 4326026 | 2/1995 |
| DE | 69 609 229 | 12/2000 |
| DE | 69 617 400 | 8/2002 |
| EP | 0492185 | 7/1992 |
| EP | 0736475 | 10/1996 |
| EP | 0795502 | 9/1997 |
| EP | 1321404 | 6/2003 |
| GB | 921679 | 3/1963 |
| JP | 58100866 | 6/1983 |
| WO | WO95/09797 | 4/1995 |

OTHER PUBLICATIONS

Search Report dated Jul. 12, 2010, corresponding Swiss Application No. CH2010 01274/10.

* cited by examiner

APPARATUS FOR ALIGNING A SHEET PRODUCT

CROSS REFERENCE TO RELATED APPLICATIONS

The present application claims priority to Swiss Patent Application No. CH 2010 01274/10, filed Aug. 6, 2010, which is hereby incorporated by reference in its entirety.

BACKGROUND OF THE INVENTION

1. Field of Invention

The present invention resides in the field of materials handling technology and relates to an apparatus for aligning a sheet product conveyed on a conveying surface of a conveyor system, according to the preamble to claim 1. The invention further relates to a method for aligning the sheet product through the use of said apparatus, as claimed in claim 14.

2. Description of Related Art

Conveyor systems for sheet products, such as, for example, printed matter, are known to the person skilled in the art. The products are here conveyed on a conveyor system and are aligned by means of guide plates and/or stop cams. Specifically in the conveyance of printed matter, whole stacks of sheet products are often conveyed.

In this context, CH-A-699 597, for instance, discloses a conveying apparatus for conveying and aligning sheet products or stacks of sheet products. The products can be aligned at their trailing edge by means of sliding cams and at their leading edge by means of cams which run ahead of the sliding cams. With this apparatus it is possible to align sheet products or a stack of sheet products along an edge running at right angles to the direction of conveyance.

GB-A-921 679 discloses an apparatus for aligning sheet products which are transported by means of a conveyor belt defining a conveying surface. Furthermore, an alignment conveyor belt is arranged so as to bear directly against the conveying surface of the conveyor belt.

The direction of conveyance of the alignment conveyor belt runs at an acute angle to the direction of conveyance of the conveyor belt. The alignment conveyor belt takes up an article conveyed by the conveyor belt, which is then laterally displaced by the alignment conveyor belt with respect to the direction of conveyance of the conveyor belt and is brought to bear with a side edge against the alignment surface and is then aligned. Owing to the narrow gap between the alignment conveyor belt and the conveyor belt, the apparatus according to GB A-921 679 is geared to aligning only single articles. By contrast, no provision is made for conveying stacks of products.

Particularly in the case of printed matter, moreover, it is often wished to align only the topmost product of a product stack. In known alignment systems, the problem often exists that, because of the comparatively large force acting upon the topmost sheet product, the bottom products of the product stack are displaced due to friction. The adjustment of the force then proves difficult, particularly when, as described in GB-A-921 679, rollers are used to align the products.

BRIEF SUMMARY

The object of the present invention is to provide a simple and reliable apparatus for aligning a product, which apparatus also allows the alignment of just the topmost product of a product stack. Alignment means moving the product relative to the undisturbed conveying movement. The object is to displace or turn the product into a desired position and situation, for example with respect to a further article.

The object is achieved with an apparatus as claimed in claim 1. Preferred embodiments are defined in the dependent claims.

The apparatus according to the invention serves for the alignment of a sheet product conveyed on a conveying surface of a conveyor system at a conveying velocity.

The sheet product here has on its side facing away from the conveying surface an at least partially exposed surface. Preferably, this surface is fully exposed. According to the invention, an alignment unit of the apparatus is arranged above the conveying surface of the conveyor system, which alignment unit changes the situation of the product with respect to the undisturbed conveying movement by means of a force acting upon the exposed surface. The alignment unit has for this purpose a self-contained, flexible force transmission member, which, on that side of the alignment unit which is facing toward the conveying surface, forms a sagging strand, which latter is intended to come into contact with the at least partially exposed surface of the product and act upon the product with the force. The product can thereby be displaced or turned. Trials have shown that this force is comparatively small.

Sagging here means that the strand has a convex shape in the direction of the conveying surface and is not stretched in a straight line. The strand is virtually free of tensile stress; it can simply have a tensile stress due to its own weight and as a result of the friction and acceleration forces generated during operation. The strand comes into contact with the product and subjects the at least partially exposed surface to comparatively small forces along a contact length. The product is thus accompanied along a contact length by the force transmission member.

The use of a sagging strand allows an as gentle as possible displacement of the product to be aligned. The strand here applies to the at least partially exposed surface, or the product in question, a force which is substantially independent of the thickness of the product. An even alignment of the sheet products can hence be achieved irrespective of the thickness or of a stack height.

Through the use of the sagging strand or of the relatively small force applied to the product by this strand, the apparatus according to the invention makes it possible to displace only that product of a product stack which comes into contact with the strand. In general, this is primarily the topmost product of a product stack, since this, on its side facing away from the conveying surface, has an exposed surface. Other products are not displaced by the friction.

Even if the conveyed product stacks have different heights, only that product which comes into contact with the strand is aligned. The strand thus adapts to the respective stack height. If a stack with relatively large stack height, for instance, passes the alignment unit, then the force transmission member readily yields. Problems and breakdowns which may arise in this regard in the case of fixedly disposed rollers can thus be avoided.

According to a further preferred embodiment, the force transmission member is driven. Preferably, a separate motor, which drives the force transmission member, is used. Such a drive enables the alignment of the product to be accurately controlled; a product can be accelerated or slowed in relation to the conveying velocity and can thus be appropriately aligned.

It is also conceivable to drive the force transmission member by means of a disengageable clutch with or without a gear transmission. In this case, the disengageable clutch can be connected to a drive of the conveyor system. This has the advantage that an additional drive can be dispensed with and, when the conveyor system is halted, the alignment unit or the force transmission member also comes automatically to a halt.

According to a further preferred embodiment, the force transmission member is configured as a link chain, as a band or as a belt. Through such a configuration, an efficient and, at the same time, gentle force transmission is obtained.

According to a further embodiment, the force transmission member has during operation a rotational velocity which is greater than the conveying velocity of the conveyor system in order to align the product by means of a—viewed in the direction of conveyance—leading edge. As a result, the sheet product is moved with respect to the conveying surface and accelerated with respect to the conveying velocity. Also, just that velocity component of the rotational velocity which acts in the direction of the direction of conveyance can be greater than the conveying velocity. This can be the case where directions of conveyance of the alignment unit and of the conveyor system are aligned crookedly in relation to each other.

According to a further embodiment, the rotational velocity of the force transmission member is less than the conveying velocity of the conveyor system in order to align the product by means of a—viewed in the direction of conveyance—trailing edge. The product is hence moved with respect to the conveying surface and decelerated with respect to the conveying velocity. Also, just that velocity component of the rotational velocity which acts in the direction of the direction of conveyance can be less than the conveying velocity. A lesser rotational velocity than the conveying velocity means also that the rotational velocity can be counterdirectional to the conveying velocity.

Furthermore, depending on the objective, it may be preferable for the strand, in a projection into the conveying surface, to form an angle of preferably 2°-30°, particularly preferably 5°-15°, with the direction of conveyance. This allows the product to be moved laterally and thus aligned.

According to a further embodiment, it is conceivable to arrange at least two alignment units above the conveying surface one behind the other, therefore one after another. The product can hence be displaced over a greater section or distance, for example obliquely to the direction of conveyance.

A further preferred embodiment relates to an apparatus having two alignment units, which are arranged such that, measured in the direction of conveyance, they overlap. The force transmission member of a first of these alignment units here has a greater rotational velocity than the conveying velocity of the conveyor system and the force transmission member of a second of these alignment units has a lesser rotational velocity than the conveying velocity of the conveyor system. Through such a configuration, it is possible to turn the product—similarly to a tracked vehicle.

A further embodiment relates to two alignment units, which are arranged above the conveying surface such that, measured in the direction of conveyance, they overlap. The force transmission member of a first alignment unit here has a greater rotational velocity than the conveying velocity and the force transmission member of a second of these alignment units has a lesser rotational velocity than the conveying velocity.

With such an arrangement, the sheet product can be turned. With the described embodiment, it is also conceivable to align the sheet product, in addition to the turning, at its leading or trailing edge.

It is further conceivable to configure the apparatus such that the portion or the contact length of the first alignment unit has a different length than the portion or the contact length of the second alignment unit, the first alignment unit preferably being arranged further upstream than the second alignment unit. This allows a more varied use of the apparatus. For example, the product can already be taken up by a further, second alignment unit, even if an operating range of the first alignment unit has not yet been left. Both alignment units thus have a—measured in the direction of conveyance—overlap region with a further alignment unit, and a free region, i.e. a region in which the alignment unit alone acts upon the sheet product.

According to a further embodiment, the force transmission member runs around a rotatable roller. The strand here runs with an upstream-situated end portion from the roller in a direction towards the conveying surface and with a downstream-situated end portion in a direction away from the conveying surface, to the roller or, if present, to a second, downstream roller. This facilitates the driving of the force transmission member and at the same time enables optimal guidance of the same. It further allows the alignment unit or the force transmission member to be configured so as to obtain a relatively large contact area between the strand and the sheet product, whereby a good force transmission from the strand to the product is ensured.

According to a further embodiment, the two rollers and an intervening guide roller are mounted on a bearing element. The force transmission member is here guided around the two rollers and the guide roller in a Ω-like manner, known in crane construction as reeving. Through such an arrangement, an optimal guidance of the force transmission member in the rollers is achieved, whereby an optimization of the drive force transmission is obtained.

In a further embodiment, the alignment unit has a pressure roller which is resiliently biased in the direction of the single roller or of the upstream roller and which, together with the roller in question, forms a guide gap for the force transmission member, which guide gap runs at least approximately at right angles to the conveying surface. As a result of this guide gap, the strand runs with an upstream-situated end portion at least approximately at right angles against the conveying surface.

According to a further embodiment, the alignment unit has a spring finger, which protrudes in the direction of the sagging strand and has at the free end a freely rotatable roll, which applies to the strand in the portion a force directed in the direction of the conveying surface. As a result of such an arrangement, the contact between the force transmission member or the strand and the at least partially exposed surface of the product is ensured in order preferably to influence heavier products.

The present invention further relates to a method for aligning a sheet product through the use of an apparatus as claimed in patent claim 1.

A further embodiment of the method according to the invention relates to the alignment of the sheet product, which latter is first moved from a first alignment unit with respect to an undisturbed conveying movement in the direction of the direction of conveyance and still during this movement reaches an overlap region between the first and a second alignment unit. The second alignment unit here preferably has a lesser rotational velocity than the first alignment unit and the conveying velocity. Through the simultaneous action of the forces of the first and second alignment units (14', 14"), the product is turned and, after leaving the overlap region, is further influenced by the second alignment unit. As a result of such a method, it is possible to align the product at its trailing or leading edge or, if the product is arranged on a product stack and overtops conveying cams, to turn said product with respect to the underlying products.

BRIEF DESCRIPTION OF THE FIGURES

The invention is explained in greater detail on the basis of the embodiments represented in the drawings, in which, in purely schematic representation.

DETAILED DESCRIPTION OF VARIOUS EMBODIMENTS

Figure 1:
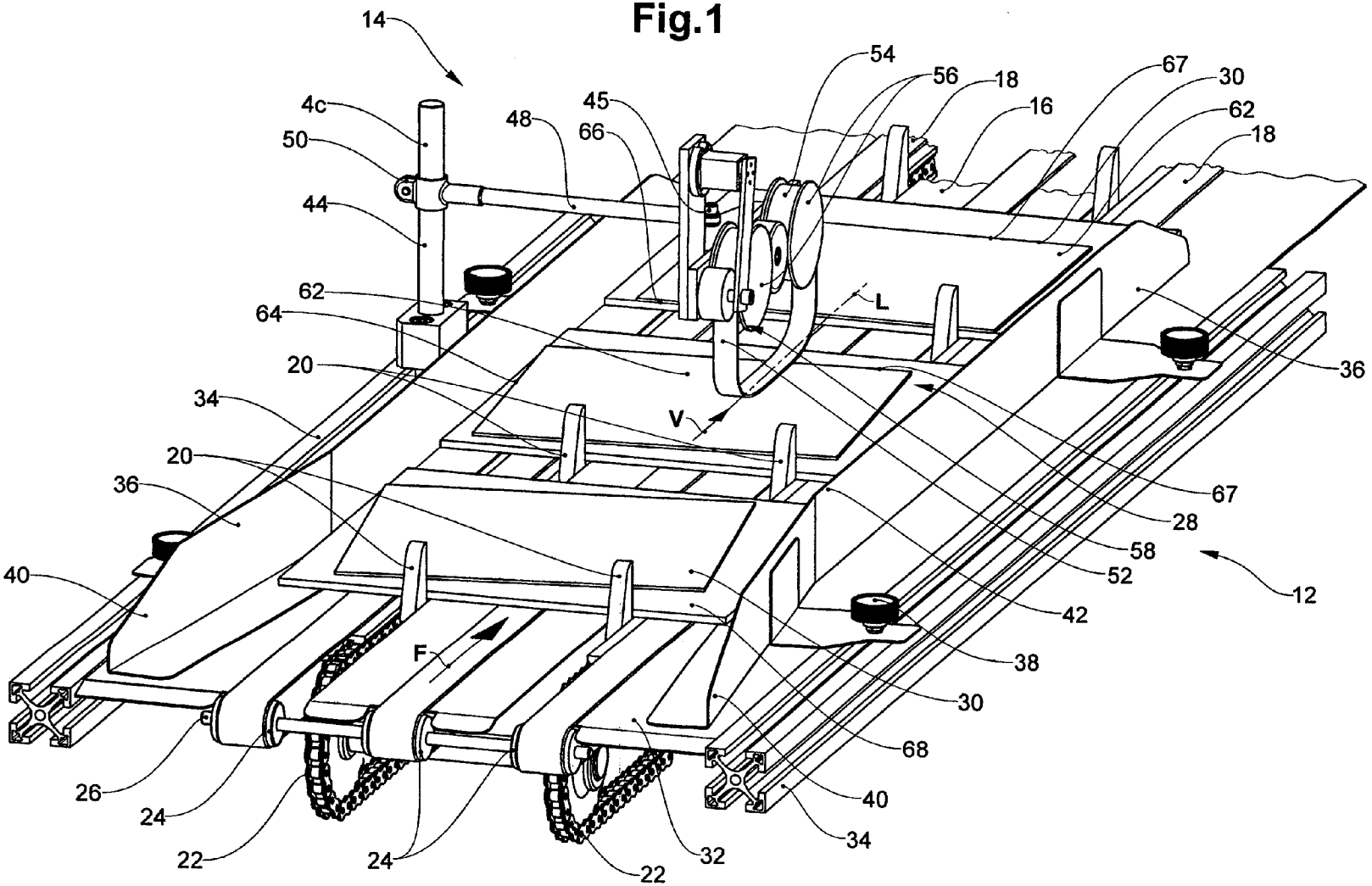
FIG. 1 shows in perspective view a part of an apparatus according to the invention comprising a conveyor system, with sheet products conveyed on a conveying surface of the conveyor system, and an alignment unit, the longitudinal axis of which is aligned parallel to the direction of conveyance of the conveyor system.

FIG. 1 shows an apparatus 10 comprising a conveyor system 12 and an alignment unit 14. The conveyor system 12 comprises a conveying surface 16, conveyor belts 18 and trailing, paired conveying cams 20, which are driven by a chain conveyor 22. A direction of conveyance F is defined by the conveyor system 12. The conveyor belts 18 are driven by means of rolls 24 mounted on an axle 26. The conveying cams 20 are configured such that they are beveled at their upstream-situated end in the direction of conveyance F and form in pairs, up to the respective leading or trailing paired conveying cams 20', a conveying section 28. As a result of the beveled configuration of the conveying cams 20, sheet products 30 slide along the conveying cams 20 as the conveyor system 12 is loaded. The conveying surface 16 is formed by the conveyor belts 18 and support elements 32. On the, in the direction of conveyance F, lateral marginal regions of the conveying surface 16 are respectively arranged profile rails 34. The conveying surface 16 is laterally bounded by guide plates 36, which are fastened to the profile rails 34 by means of screws 38. In an end region of the guide plates 36, which end region is situated upstream with respect to the direction of conveyance F, said guide plates have funnel-like inlets 40 which are open outward in the direction of the profile rails 34. These funnel-like inlets 40 serve to lead the sheet products 30 into a defined path 42 and to prepare them for treatment by means of the alignment unit 14. In FIG. 1, the sheet products 30 conveyed on the conveying surface 16 comprise a sheet product 30', on which is arranged a further sheet product 30 having a shorter extent than the product 30'.

The alignment unit 14 is disposed on a holding arm 44, which is fastened to the profile rail 34. Preferably, the alignment unit 14 is here fastened to the holding arm 44 by a screw connection 45. The holding arm 44 has a vertical portion 46 and a horizontal portion 48. In the shown embodiment, the horizontal portion 48 is fastened to the vertical portion 46 in a height-adjustable manner by means of a clamping fixture 50. As a result of the screw connection 45, it is possible to align the alignment unit 14, or the direction of conveyance V thereof, in relation to the direction of conveyance F of the conveyor system 12. In the embodiment shown in FIG. 1, a projection into the conveying surface 16 of a sagging strand 52 runs parallel to the direction of conveyance F. The longitudinal direction L of the alignment unit 14 is defined by this projection.

The alignment unit 14 has a force transmission member 54, which is arranged rotatably on rollers 56. The force transmission member 54 has, on a side 58 facing toward the conveying surface 16, the sagging strand 52. During operation, this strand 52 rests respectively with a portion 52' or a contact length on an at least partially exposed surface 62 of the conveyed product 30 or on the conveying surface 16. A force can hence be transmitted to the product 30. At least one of the shown two rollers 56 is in this case driven. The drive can be effected, for example, by a separate motor or a disengageable clutch with or without a gear transmission.

The shown apparatus 10 enables sheet products 30 to be displaced and aligned against guide plates 36 and/or conveying cams 20 by means of side edges 64 and/or trailing edges 66. The force transmission member 54 here has a rotational velocity which is less than the conveying velocity. By means of force transmission by the force transmission member 54 or the strand 52, the product 30 is here decelerated and aligned with a trailing edge 66 against the conveying cams 20. As can be seen from FIG. 1, the upper sheet product 30 is taken up by means of the alignment unit 14 or by means of the force transmission member 54 and aligned against the conveying cams 20. The force transmission member 54 here transmits the force to the product 30, which, on the side facing away from the conveying surface 16, has the at least partially exposed surface 62. It is also conceivable to jointly align two or more products 30, 30' situated directly one above the other. For this purpose, just the lower product 30' of the two products 30, 30' must have the at least partially upwardly exposed surface 62.

The embodiment shown in FIG. 1 comprises the three conveying sections 28. In a first shown conveying section 28, situated upstream viewed in the direction of conveyance, the product 30 is not yet aligned. In the following middle conveying section 28, the alignment unit 14 aligns the product against the conveying cams 20 by means of the trailing edge 66. In the last shown conveying section 28, viewed downstream, the product 30 is then aligned, to be precise with a trailing edge 66 bearing against the paired conveying cams 20. It is further possible to align the product 30 by means of the force transmission member 54 also against leading cams. For this, the rotational velocity of the force transmission member 54 would have to be greater than the conveying velocity, so that the product 30 can be aligned with a leading edge 67 against leading cams. The leading edges are here configured identically, or at least similarly, to the conveying cams 20, yet arranged such that they are turned precisely through 180° about their longitudinal axis.

Due to the configuration of the sagging strand 52, it is possible to align also topmost products 30 of a stack 68 of products 30. The strand 52 is here deformed in accordance with the stack 68 or stack height and thus adapts to the shape of the stack 68. The product 30 can thus be moved in relation to another, underlying product 30' of a stack 68. Moved here means slant, displace and/or turn. As already indicated, preferably only the topmost product 30 of a stack is here respectively aligned in relation to the other products 30' of the same stack 68.

Alternatively thereto, a product disposed under the topmost product 30 can also be aligned as long as it has the at least partially upwardly exposed surface 62. Preferably, the product 30' disposed under the topmost product 30 has a greater planar extent than the topmost product 30. In the example shown in FIG. 1, moreover, the product 30' having the greater extent, i.e. the underlying product 30', can be aligned, to be precise by arrangement of the alignment unit 14 such that the force transmission member 54 transmits the force to an at least partially exposed surface 62' of that product 30' having the greater extent.

Figure 2:
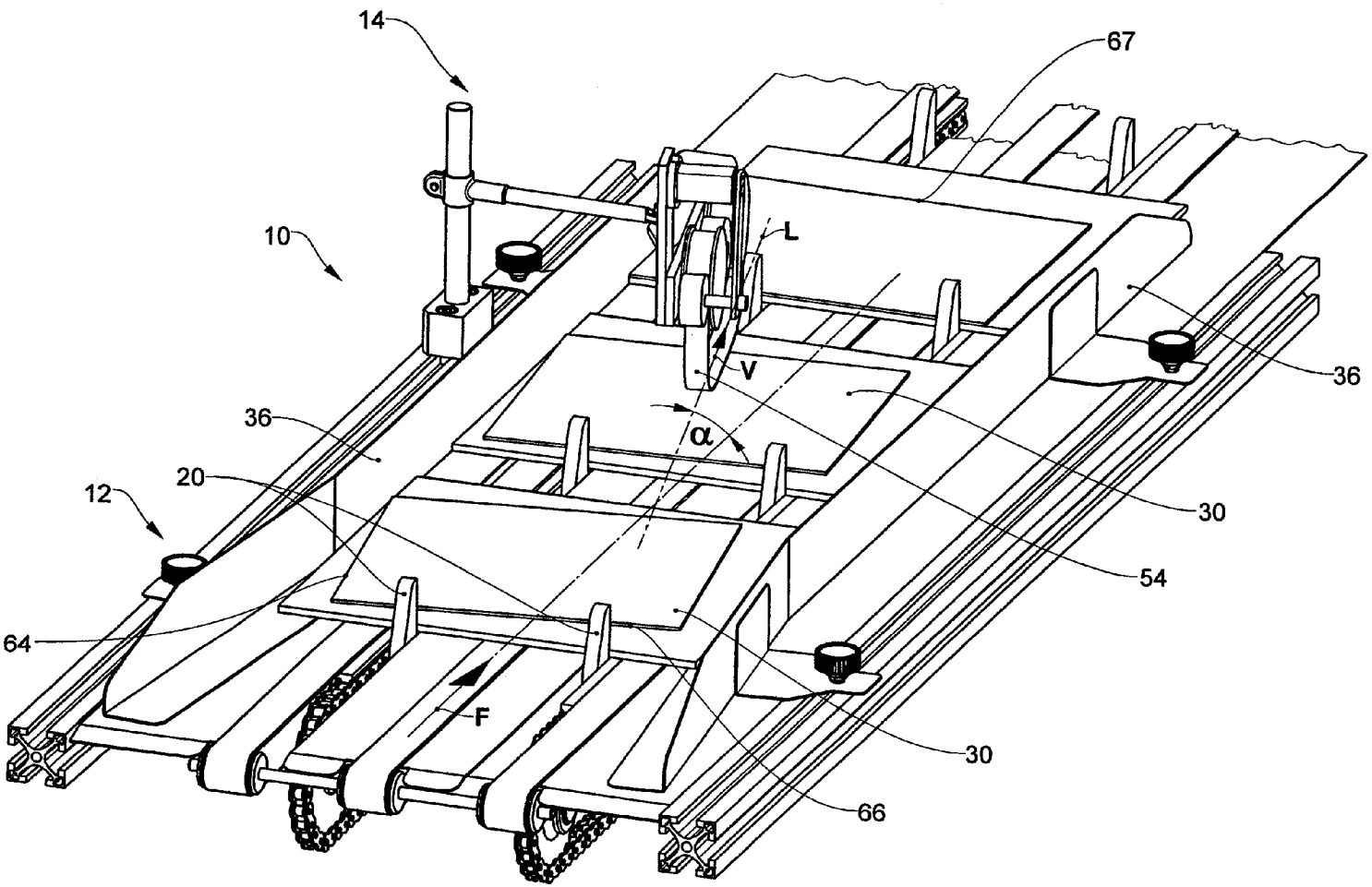
FIG. 2 shows in the same representation as FIG. 1 an apparatus analogous to the apparatus according to FIG. 1, in which the longitudinal axis of the alignment unit is aligned obliquely with respect to the direction of conveyance of the conveyor system.

FIG. 2 shows the apparatus 10 having an alignment unit 14, whereof the projection of the strand 52 into the conveying surface 16 or whereof the direction of conveyance V is slanted in relation to the direction of conveyance F of the conveyor system and forms with the latter an angle α. The angle a preferably amounts to 2° to 30°, particularly preferably 5° to 15°. Through a slanting of the alignment unit 14, not only is a transmission of a force component in the direction of the direction of conveyance F possible, but also a transmission of a force component at right angles to the direction of conveyance F and parallel to the conveying surface 16. This produces a resultant force which has a vector running obliquely to the direction of conveyance F. As a result of the resultant force, the product 30, in addition to a displacement in the direction of the direction of conveyance F and thus an alignment against the conveying cams 20 by means of the trailing edge 66, is also displaced in the conveying surface 16 along a direction running at right angles to the direction of conveyance F and aligned against the guide plate 36 with a side edge 64.

If, as shown in FIG. 1 and FIG. 2, the conveying velocity of the force transmission member 54 is less than the conveying velocity of the conveyor system 12, then the products 30 are decelerated and aligned against the trailing conveying cams 20. As already mentioned, it is also conceivable, however, to choose the conveying velocity of the force transmission member 54 such that the product 30 is accelerated in relation to the conveying velocity of the conveyor system 12 and is aligned, for example, with the leading edge 67 against leading conveying cams (not shown here).

Figure 3:
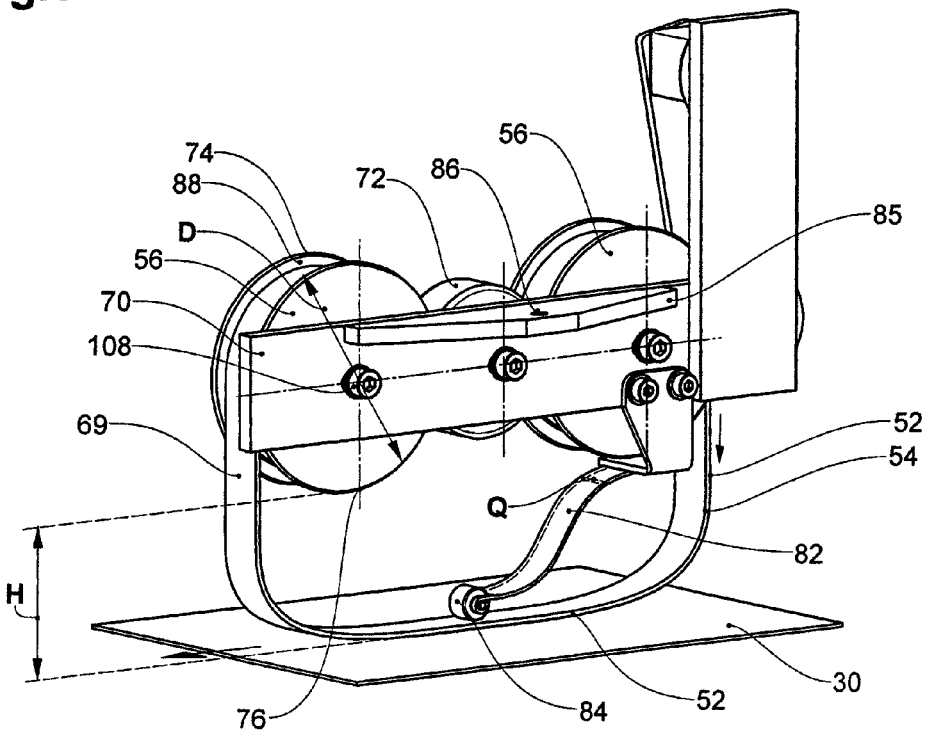
FIG. 3 shows in a perspective view the alignment unit according to FIGS. 1 and 2, having a force transmission member configured as a band.

FIG. 3 shows the alignment unit 14 or the force transmission member 54 in contact with a sheet product 30 which is being conveyed during operation. The force transmission member is formed by a belt 69 or a band 69'. The alignment unit 14 has a bearing element 70, to which the rollers 56 are fastened.

Between the two rollers 56, there is likewise arranged on the bearing element 70 a guide roller 72. The force transmission member 54 runs in a Ω-like manner over the two rollers 56, namely on the rollers 56 on the side 74 facing away from the conveying surface 16 and therebetween, i.e. on the guide roller 72, on the side 76 facing toward the conveying surface 16. The guidance of the belt 69 over the rollers 56 and over the guide roller 72 thus corresponds to a reeving. The center axes of the rollers 56 and that of the guide roller 72 lie in one plane and are aligned parallel to one another.

In the region 78 facing toward the conveying surface 16, the force transmission member 54 has the sagging strand 52. The belt 69 is generally formed of a material having a high friction coefficient, for example rubber. The belt 69 should further have a relatively high own weight in order that the strand 52 is configured in accordance with the configuration shown in FIG. 3. That portion 52' of the strand 52 which rests on the conveying surface 16 or on the product 30 is clearly discernible.

In the embodiment shown in FIG. 3, a spring finger 82 is disposed on the bearing element 70. The spring finger 82 has at its free end a freely rotatable roll 84, which applies a predetermined force to the force transmission member 54 and forces the strand 52 in the direction of the product 30. In the shown embodiment, the spring finger 82 is of S-shaped configuration, but it is also conceivable to configure this differently, for example in a straight line. The cross section Q of the spring finger 82 can be freely chosen. If the spring finger 82 is intended to be rigid in order to transmit relatively high forces to the product 30, then the cross section Q can be adapted accordingly. The same applies, of course, to relatively low forces.

On the bearing element 70 there is arranged a flange 85 protruding substantially at right angles therefrom, which flange has a hole 86. By means of the passage 86, the alignment unit 14 is fastened to the holding arm 44. In FIG. 3, it is also clearly discernible that the rollers 56, along their periphery, have a peripherally running guide, which guides guide the belt 69 on the rollers 56 and, during operation, prevent the belt 69 from slipping off the rollers 56. The guide 88 can be configured as a guide groove, guide channel or as a double flange running in the peripheral direction of the roller 56.

Figure 4:
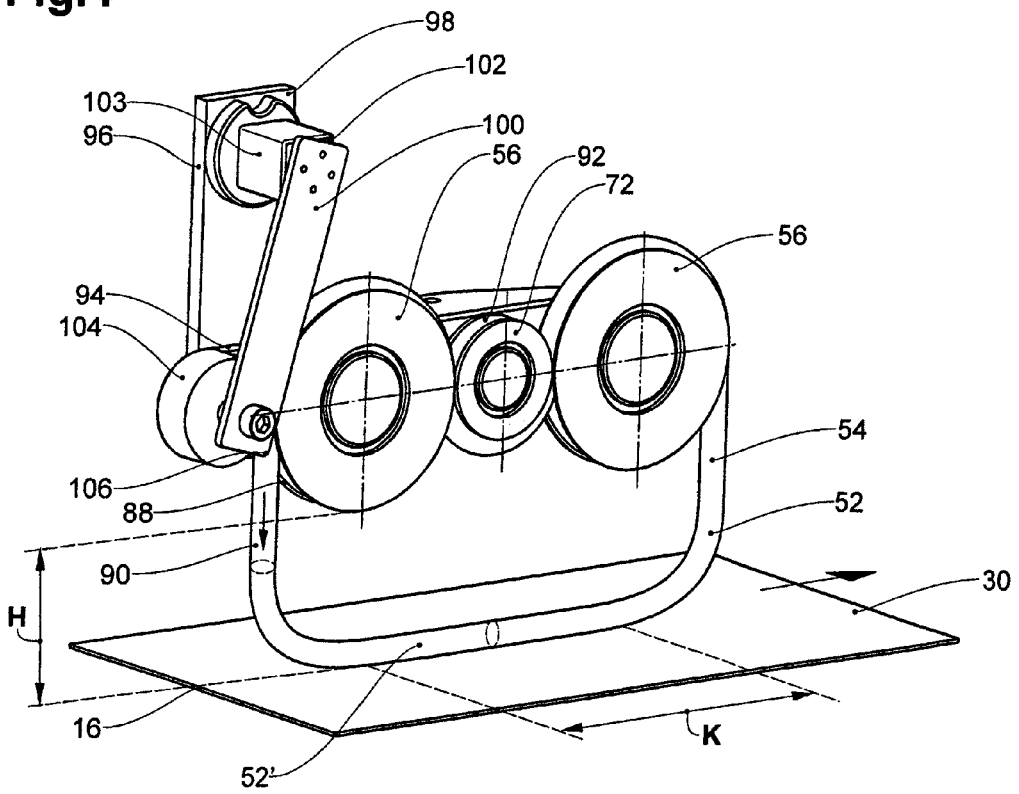
FIG. 4 shows in a perspective view, viewed from a different side than in FIG. 3, the alignment unit having a force transmission member configured as a round section belt.

FIG. 4 shows an alignment unit 14 analogous to FIG. 3, though from a different side. In this view, the bearing element 70 is concealed by the rollers 56 and the guide roller 72. In contrast to FIG. 3, in the embodiment shown in FIG. 4 the force transmission member 54 is formed by a round section belt 90. The round section belt 90 is likewise laterally guided by the guide 88. Furthermore, the guide roller 72 has along the peripheral direction a groove 92, in which the round section belt 90 is guided.

In an end region 94 of the bearing element 70 extends a vertical element 96, which in an end region 98 facing away from the bearing element 70 has an arm 100. The arm 100 is fastened to the vertical element 96 by means of an elastic body 102, for example a rubber body, and a spacer 103 and is biased by the elastic body 102 in the direction of the bearing element 70. The arm 100 has at an end facing away from the vertical element 96 a pressure roller 104, which applies to the force transmission member 54 a force in the direction of the bearing element 70. Together with the roller 56, a guide gap 106 is thus formed, which guide gap runs at least approximately at right angles to the conveying surface 16 and guides the force transmission member 54. Preferably, the center axis of the pressure roller 104 runs in the same plane as the center axes of the rollers 56 and of the guide roller 72. The rollers 56, the guide roller 72 and the pressure roller 104 are preferably fastened to the bearing element 70 or to the arm 100 by means of screws 108. Owing to its cross section, the round section belt 90 has a comparatively high own weight; a spring finger 80, which forces the round section belt 90 in the direction of the product 30, is thus not needed in this embodiment. Like the belt 69 according to FIG. 3, the round section belt 90 according to FIG. 4 is also made of a material having a high friction coefficient, for example rubber. In FIG. 4, the portion 52' is additionally labeled as a contact length K. The contact length K denotes that portion 52' of the strand 52 which comes into contact with the product 30.

Figure 5:
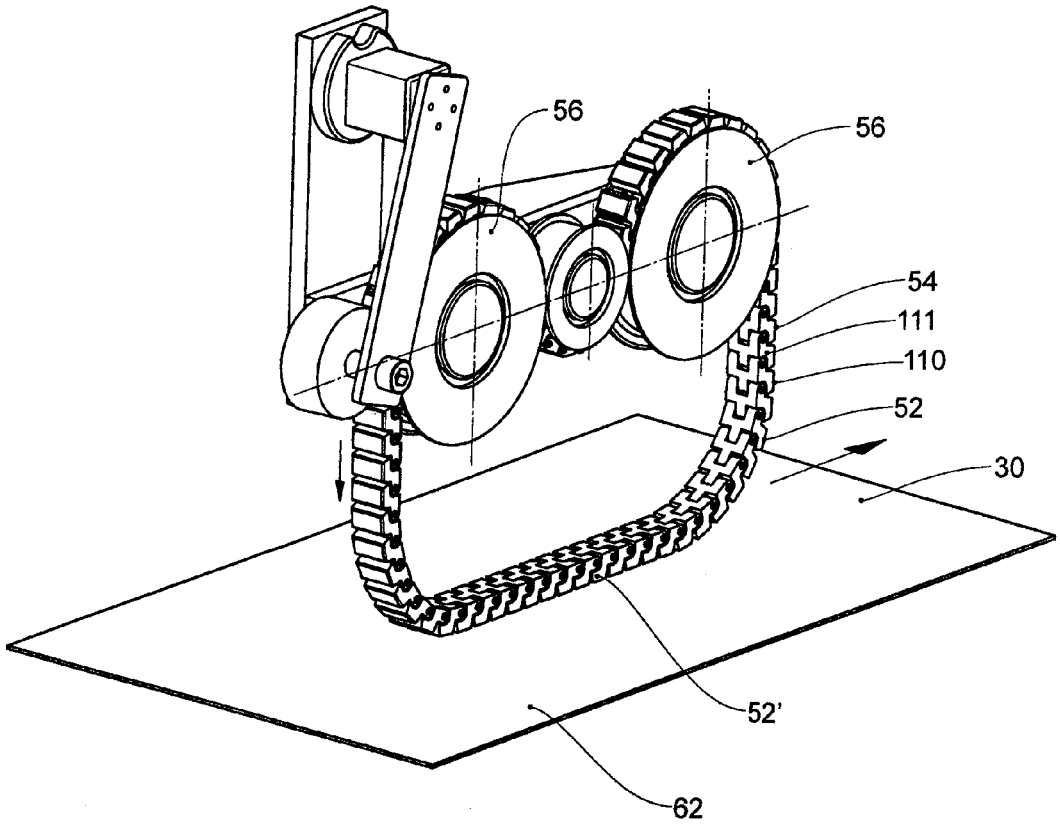
FIG. 5 likewise shows in perspective view the alignment unit having a force transmission member configured as a link chain.

FIG. 5 shows the alignment unit 14 having the force transmission member 54, which latter is configured as a link chain 110. The link chain 110 is configured such that it assumes, under its own weight, an appropriate shape, as shown in FIG. 5. It is possible to produce the link chain 110 from metal or plastic. It is also conceivable to provide that surface of a chain link 111 of the link chain 110 which is oriented peripherally outward with a coating having a high friction coefficient, for example a rubber coating. The transmission of the force from the link chain 110 to the product 30 or the partially exposed surface 62 is thereby ensured. The link chain 110 has, in comparison to a belt, a lower inherent rigidity, which, during running, impacts on the friction between the rollers 56 and the link chain 110.

Figure 6:
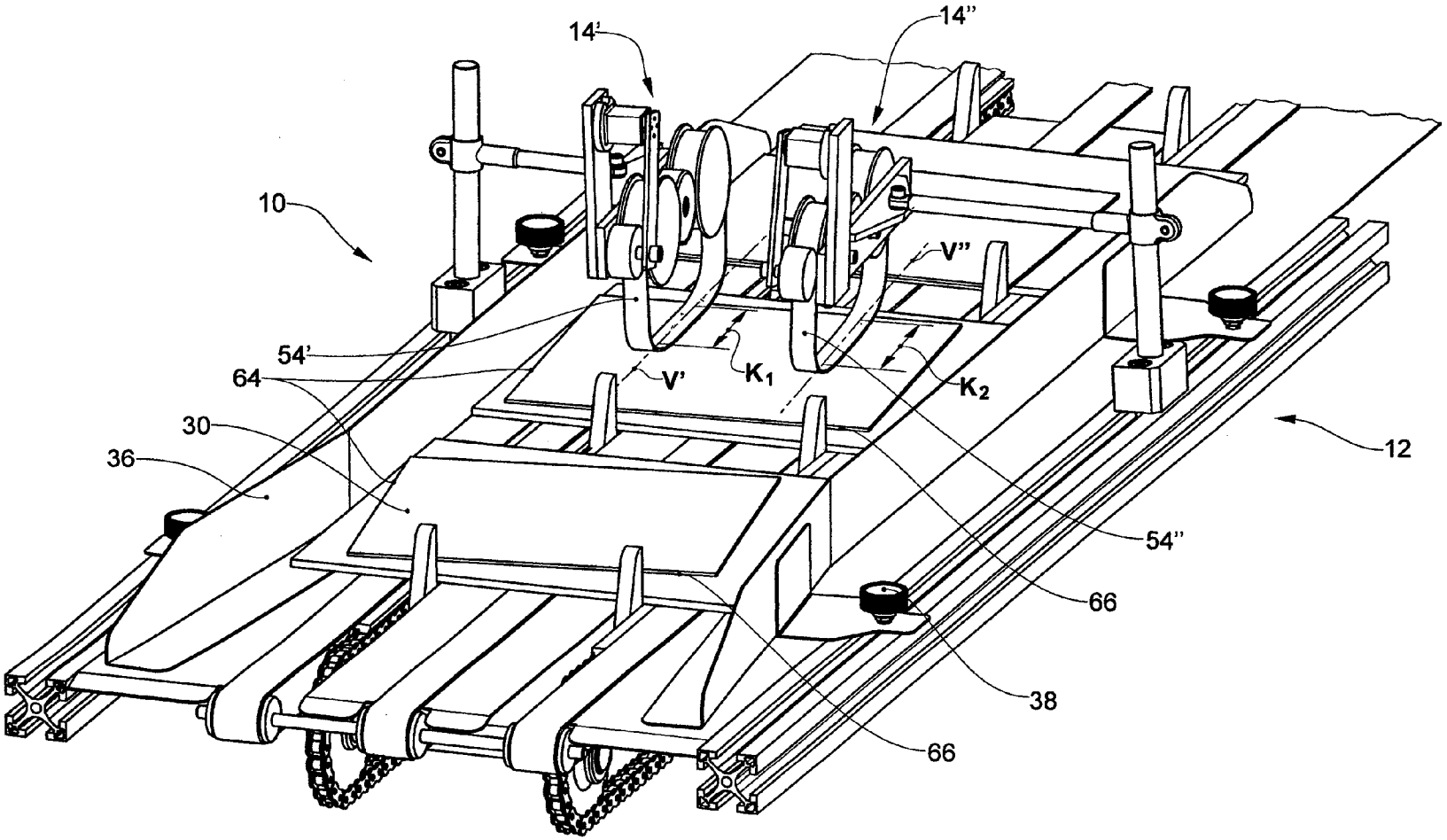
FIG. 6 shows in perspective view a part of an apparatus according to the invention having a first and a second alignment unit, which are arranged side by side at least approximately in parallel and one opposite the other.

FIG. 6 shows an apparatus 10 having a first and a second alignment unit 14' or 14". The two alignment units 14', 14" or the projections into the conveying surface 16 of the strand 52' of the first alignment unit 14' or of the strand 52" of the second alignment unit 14", and thus the directions of conveyance V', V" of the alignment units 14', 14", are aligned slightly obliquely in relation to each other.

The two alignment units 14', 14" are arranged one opposite the other. Such an arrangement allows the sheet products 30 to be turned. It is here sufficient if the rotational velocity of the force transmission member 54' of the first alignment unit 14' is greater than the conveying velocity of the conveyor system 12, and the rotational velocity of the force transmission member 54" of the second alignment unit 14" is less than or equal to the conveying velocity of the conveyor system 12. Theoretically, during running, a turning of the product 30 takes place as soon as the rotational velocity of the force transmission member 54' of the first alignment unit 14' differs from the rotational velocity of the force transmission member 54" of the second alignment unit 14". The principle behind this is the same as with a drive of tracked vehicles, which drive revolves due to different velocities of the caterpillar tracks or different values of the force vectors of the left and right caterpillar track. In the shown example in FIG. 6, the product 30 is aligned with a trailing edge 66 against the conveying cam 20, i.e. is decelerated, for example, by the first alignment unit 14', and at the same time is aligned with the side edge 64 against the guide plate 36, for example by the second alignment unit 14", the force transmission member 54 of which has a velocity component at right angles to the direction of conveyance F and parallel to the conveying surface 16. In FIG. 6, the respective contact lengths K1, K2 of the force transmission members 54', 54" are also shown. These contact lengths K1, K2 can be variously long.

Figure 7:
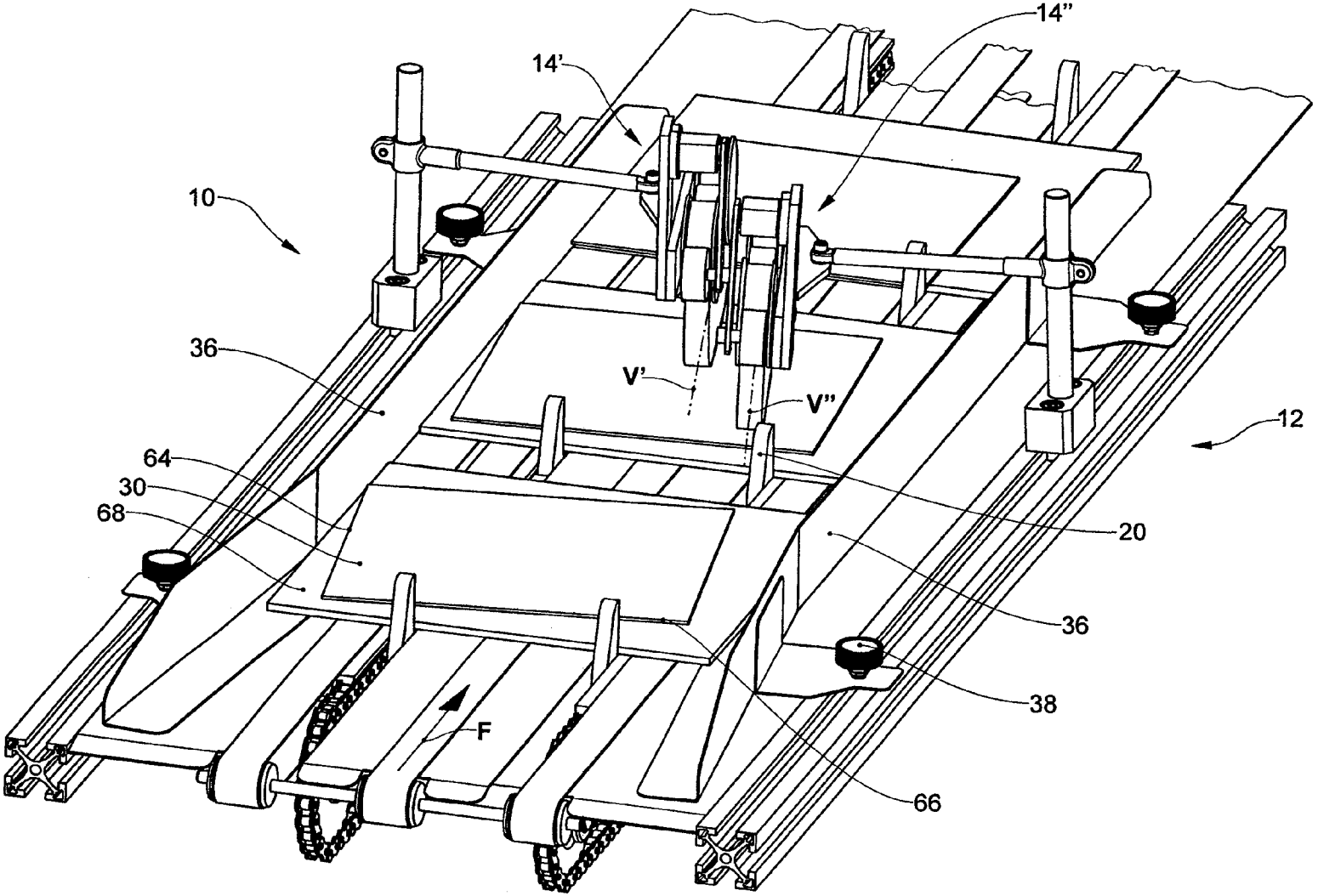
FIG. 7 shows the apparatus having a first and a second alignment unit, which are arranged one behind the other and at least approximately parallel to each other.

FIG. 7 shows an arrangement in which the first alignment unit 14' is arranged upstream of the second alignment unit 14". It is also possible to arrange the alignment units 14'/14' the other way round, to be precise to arrange the first alignment unit 14' downstream of the second alignment unit 14". The alignment units 14'/14" or their directions of conveyance V', V" are arranged at least approximately parallel to each other. The directions of conveyance V', V" of the two alignment units 14'/14" can also, however, be aligned obliquely to each other. By means of such an arrangement, it is possible to displace a sheet product 30 over a greater distance. It is conceivable, for instance, that the upstream second alignment unit 14" aligns or displaces the sheet product 30 and then the downstream first alignment unit 14' displaces the product 30 still further and, by means of the side edge 64 and the trailing edge 66, aligns it against the guide plate 36 or against the conveying cams 36, as is shown in FIG. 7. In principle, a turning of the products is possible also with an apparatus 10 according to FIG. 7.

Figure 8:
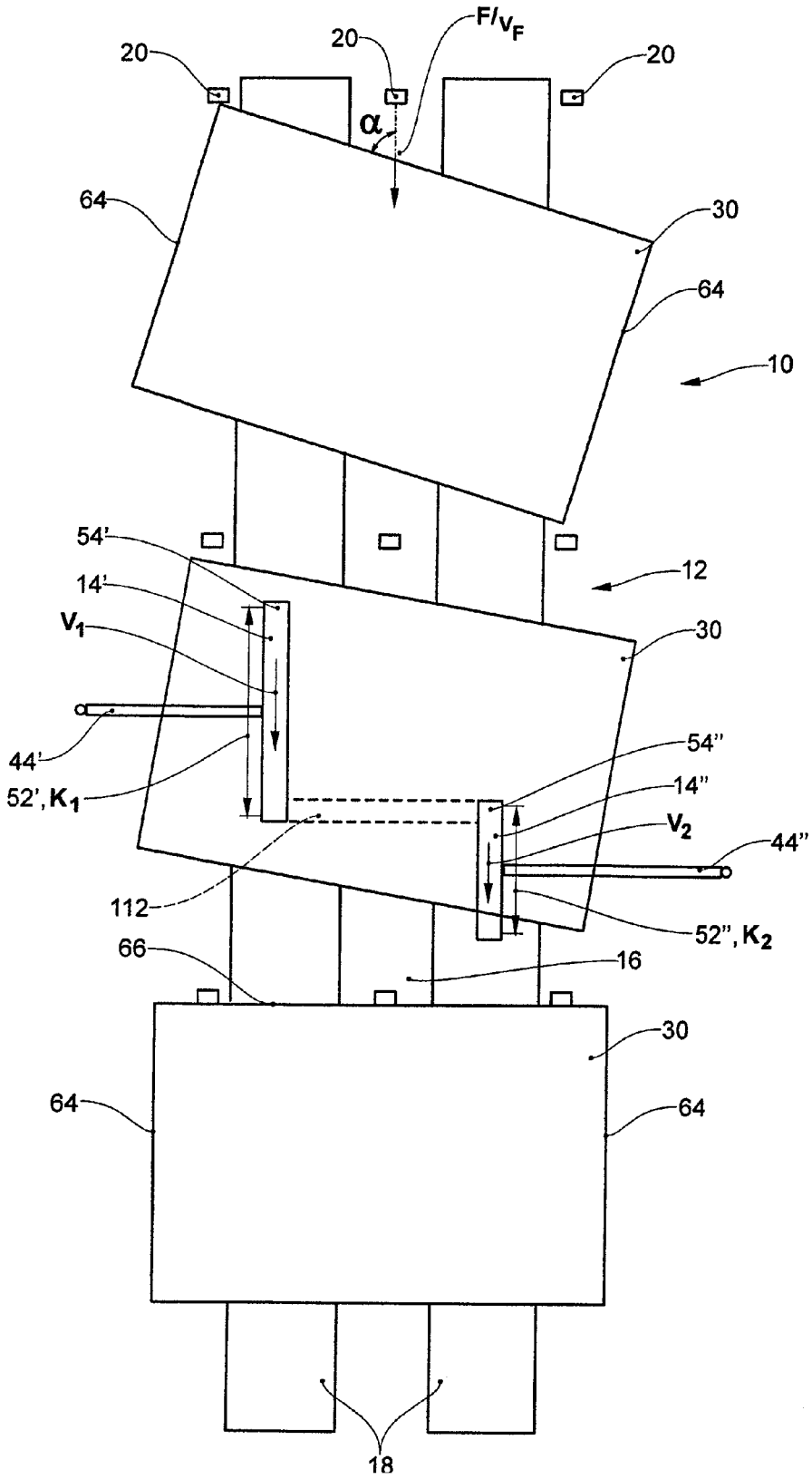
FIG. 8 shows the apparatus having a first and a second alignment unit, which have portions or contact lengths of different length.

FIG. 8 shows an arrangement having two alignment units 14', 14", which are arranged such that they are offset laterally and in the direction of conveyance F.

The portions 52', K1, 52", K2 of these two alignment units 14', 14" overlap, however, in a an overlap region 112 measured in the direction of conveyance. The first alignment unit 14' is arranged further upstream with respect to the second alignment unit 14". The force transmission member 54" or the strand 52" of the second of the two alignment units 14', 14" has a shorter contact length K2 or a shorter portion 52' than the force transmission member 54' or the strand 52' of the first alignment unit 14'. Furthermore, the rotational velocity $V_1$ of the first alignment unit 14' is greater than the conveying velocity $V_F$ and the rotational velocity $V_2$ of the second alignment unit 14" is less than the conveying velocity $V_F$. Less can also mean that the rotational velocity $V_2$ of the second alignment unit 14" is contrary to the conveying velocity $V_F$.

Such an arrangement allows the alignment of a sheet product 30 which lies obliquely on the conveying surface 16 by an angle a with respect to the direction of conveyance F. In this case, the first alignment unit 14' takes up the product 30 and moves this in the direction of the direction of conveyance F. Still during this movement, the product 30 is taken up in the overlap region 112 by the force transmission member 54" of the second alignment unit 14" and decelerated by this and, consequently, in interaction with the force transmission member 54' of the first alignment unit 14', turned. Following the turning, the edges of the sheet product 30 are preferably aligned at right angles or parallel to the direction of conveyance F. After this, as soon as the product 30 leaves the overlap region 112, it is aligned with its trailing edge 66 against the trailing conveying cam 20 by the second alignment unit 14". That is to say that, following the alignment, the trailing edge 66 of the product 30 runs at right angles to the direction of conveyance F and bears against conveying cams 20. With such an apparatus, it is also conceivable to slant or turn the product 30 which is delivered aligned with its side edges 64 parallel to the direction of conveyance. In this case, preferably no conveying cams 20 are fitted on the conveyor system 12 and the product 30 is conveyed merely by means of a conveyor belt.

Depending on the objective, it can be advantageous for the conveyor system 12 to have just a conveyor belt, but no conveying cams 20. This is the case, for instance, when the sheet products 30 are intended to be turned through, for example, 90°. If conveying cams 20 are also present in this case, then the stack 68 should have a stack height which is greater than the height of conveying cams in order that the topmost sheet product 30, when turned, does not butt against the conveying cams 20.

As mentioned, it is also conceivable, with the shown apparatus, to process stacks 68 of sheet products 30. Here, only that product 30 which has an upwardly at least partially exposed surface 62 is respectively displaced. This product 30 does not necessarily have to be the topmost product 30 of the stack.

Furthermore, with the described apparatus 10 or the alignment unit 14, it is possible to align products 30 which are conveyed on a conveyor system 12 having inclined conveying surfaces 16. Such a conveyor system is described, for instance, in CH-A-699 866.

CH-A-699 866 discloses an apparatus for collating sheet products. The sheet products or stacks of sheet products come to lie on a receiving unit, which has a gripper having a first and a second gripper jaw. One of these gripper jaws here forms a support surface for the products, whereby a fan-like conveying element is formed. The support surface of these conveying elements is inclined in relation to the conveying surface. That force transmission member 54 of the present invention which forms the sagging strand 52 can readily adapt to conveying surfaces 16 which are thus inclined.

As a result of the clear height H, which is clearly visible, for example, in FIG. 3, the sagging strand 52 enables a varied use of the alignment unit 14. The clear height H allows the alignment of products 30 or stacks 68 of products 30 of different stack height which are all conveyed, however, in the same conveying cycle. The clear height H is here preferably at least as large as a diameter D of the roller 56. As stated above, the present invention thus also allows the alignment of products 30 conveyed with a system according to CH-A-699 866.

Particularly in the alignment unit 14 having the link chain 110, it is conceivable to replace at least the rollers 56 by gearwheels. By means of the gearwheels, the drive force can be neatly transmitted to the link chain 110 and the lateral guidance of the same proves simple.

I claim:

1. An apparatus for aligning a sheet product, the apparatus comprising:

a conveyor system for conveying the sheet product on a conveying surface of the conveyor system in a direction of conveyance (F) at a conveying velocity ($V_F$); and at least one alignment unit having a self-contained, flexible force transmission member, and the sheet product having, on its side facing away from the conveying surface, an at least partially exposed surface, wherein:

the at least one alignment unit is arranged above the conveying surface and is configured to change the situation of the product with respect to its undisturbed conveying movement on the conveying surface by means of a force transmitted directly onto the exposed surface, the exposed surface being a surface of the sheet product arranged parallel to the conveying surface;

the self-contained, flexible force transmission member forms a sagging strand, on that side of the alignment unit which is facing toward the conveying surface; and the sagging strand is configured to rest with a portion (K1) on the at least partially exposed surface of the product and thus subject said product to the force.

2. The apparatus for aligning products as claimed in claim 1, wherein the force transmission member is driven.

3. The apparatus for aligning products as claimed in claim 1, wherein the force transmission member is driven via a disengageable clutch connected to a drive of the conveyor system.

4. The apparatus for aligning products as claimed in claim 1, wherein the force transmission member is configured as a link chain, as a band or as a belt.

5. The apparatus for aligning products as claimed in claim 1, wherein the force transmission member has during operation a rotational velocity ($V_1$) which is greater than the conveying velocity ($V_F$) of the conveyor system in order to align the product by means of a -viewed in the direction of conveyance (F)—leading edge.

6. The apparatus for aligning products as claimed in claim 1, wherein the force transmission member has during operation a rotational velocity ($V_1$) which is less than the conveying velocity ($V_F$) of the conveyor system in order to align the product by means of a -viewed in the direction of conveyance (F)—trailing edge.

7. The apparatus for aligning products as claimed in claim 1, wherein the sagging strand, in a projection into the conveying surface, forms an acute angle with the direction of conveyance (F).

8. The apparatus for aligning products as claimed in claim 1, wherein at least two alignment units are arranged one after another.

9. The apparatus for aligning products as claimed in claim 1, wherein two alignment units are arranged such that, measured in the direction of conveyance, they overlap, the force transmission member of a first of these alignment units having a greater rotational velocity ($V_1$) than the conveying velocity ($V_F$) and the force transmission member of a second of these alignment units has a lesser rotational velocity ($V_2$) than the conveying velocity ($V_F$) in order to turn the product.

10. The apparatus for aligning products as claimed in claim 9, wherein the portion (K1) of the first alignment unit has a length different than the portion (K2) of the second alignment unit.

11. The apparatus for aligning products as claimed in claim 1, wherein the force transmission member runs around a rotatable roller and the sagging strand runs with an upstream-situated end portion from the roller in a direction towards the conveying surface and with a downstream-situated end portion in a direction away from the conveying surface, to the roller or, if present, to a second, downstream roller.

12. The apparatus for aligning products as claimed in claim 11, further comprising a pressure roller which is resiliently biased in the direction of the roller and which, together with the roller, forms a guide gap for the force transmission member, which guide gap runs at least approximately at right angles to the conveying surface.

13. The apparatus for aligning products as claimed in claim 1, wherein the alignment unit has a spring finger, which protrudes in the direction of the sagging strand and has at the free end a freely rotatable roll, which applies to the strand in the portion (K1) a force directed in the direction of the conveying surface.

14. A method for aligning a sheet product conveyed on a conveying surface of a conveyor system in a direction of conveyance (F) at a conveying velocity ($V_F$), the method comprising the steps of:

providing a conveyor system comprising an alignment unit arranged above the conveying surface, the alignment unit comprising a flexible force transmission member; and positioning the sheet product such that a side thereof is facing away from the conveying surface and comprises an at least partially exposed surface, wherein:

the exposed surface is a surface of the sheet product arranged parallel to the conveying surface and is subjected directly to a force, by means of the alignment unit, so as to change the situation of the product with respect to its undisturbed conveying movement on the conveying surface;

the product is subjected to the force by the self-contained, flexible force transmission member of the alignment unit; and the force transmission member, on that side of the alignment unit which is facing toward the conveying surface, forms a sagging strand resting with a portion (K1) on the at least partially exposed surface of the product.

15. The method as claimed in claim 14, wherein the sheet product is first moved from a first alignment unit with respect to an undisturbed conveying movement in the direction of the direction of conveyance (F) and still during this movement reaches an overlap region between the first and a second alignment unit, which second alignment unit preferably has a lesser rotational velocity ($V_2$) than the first alignment unit and the conveying velocity ($V_F$) and, through the simultaneous action of the forces of the first and second alignment units, is turned and preferably, after leaving the overlap region, is further influenced by the second alignment unit.

* * * * *